US008104577B1

(12) United States Patent
Reed

(10) Patent No.: US 8,104,577 B1
(45) Date of Patent: Jan. 31, 2012

(54) LADDER STABILIZER FOR FLATBED TRUCK

(76) Inventor: James L. Reed, Dearing, GA (US)

( * ) Notice: Subject to any disclaimer, the term of this patent is extended or adjusted under 35 U.S.C. 154(b) by 410 days.

(21) Appl. No.: 12/321,056

(22) Filed: Jan. 15, 2009

(51) Int. Cl.
*E06C 5/00* (2006.01)

(52) U.S. Cl. ..... 182/127; 182/82; 182/214; 248/210

(58) Field of Classification Search ..... 182/127, 182/82, 93, 206, 214; 248/210, 225.11, 238, 248/211, 300, 297.21
See application file for complete search history.

(56) References Cited

U.S. PATENT DOCUMENTS

| | | | | | |
|---|---|---|---|---|---|
| 3,491,852 | A | * | 1/1970 | Leist | 182/117 |
| 3,894,707 | A | * | 7/1975 | Heard | 248/230.9 |
| 3,989,122 | A | | 11/1976 | Jenkins | |
| 4,163,425 | A | | 8/1979 | Bédard | |
| 4,458,783 | A | * | 7/1984 | Stakes | 182/206 |
| 4,482,029 | A | * | 11/1984 | Prochaska | 182/96 |
| 4,483,416 | A | | 11/1984 | Garcia | |
| 4,569,449 | A | * | 2/1986 | Brent | 211/86.01 |
| 4,613,135 | A | * | 9/1986 | Rush | 473/488 |
| 4,638,885 | A | * | 1/1987 | Frederick | 182/151 |
| D289,007 | S | | 3/1987 | Garcia | |
| D290,931 | S | | 7/1987 | Powell | |
| 4,751,981 | A | * | 6/1988 | Mitchell et al. | 182/127 |
| 4,823,912 | A | * | 4/1989 | Gould et al. | 182/214 |
| 4,883,393 | A | | 11/1989 | Acquaro | |
| 4,899,970 | A | * | 2/1990 | Berzina | 248/210 |
| 4,923,103 | A | * | 5/1990 | Sauber | 224/546 |
| 4,995,578 | A | * | 2/1991 | Monheim | 248/210 |
| 5,117,941 | A | * | 6/1992 | Gruber | 182/107 |
| 5,358,071 | A | * | 10/1994 | Stennett | 182/214 |
| 5,469,933 | A | * | 11/1995 | Thomason | 182/127 |
| 5,624,127 | A | * | 4/1997 | Arreola et al. | 280/163 |
| 5,795,115 | A | | 8/1998 | Collins | |
| 5,941,342 | A | * | 8/1999 | Lee | 182/95 |
| 6,019,191 | A | * | 2/2000 | Flores | 182/107 |
| 6,029,774 | A | * | 2/2000 | Cothern | 182/107 |
| 6,244,551 | B1 | * | 6/2001 | Fletcher | 248/238 |
| 6,257,534 | B1 | * | 7/2001 | Finley | 248/201 |
| 6,264,151 | B1 | * | 7/2001 | Schiller | 248/238 |
| 6,578,666 | B1 | * | 6/2003 | Miller | 182/127 |
| 6,722,469 | B1 | * | 4/2004 | Weger, Jr. | 182/107 |
| 6,767,023 | B1 | * | 7/2004 | Nicholson | 280/165 |
| 7,111,858 | B2 | * | 9/2006 | Manser et al. | 280/163 |
| 7,131,516 | B1 | * | 11/2006 | Krol | 182/206 |
| 7,293,630 | B1 | | 11/2007 | Trebec | |
| 2002/0079413 | A1 | * | 6/2002 | Hileman et al. | 248/210 |
| 2002/0189903 | A1 | * | 12/2002 | Krish, Jr. | 182/206 |
| 2007/0182194 | A1 | | 8/2007 | Wood | |
| 2009/0152046 | A1 | * | 6/2009 | Stewart et al. | 182/127 |
| 2010/0096215 | A1 | * | 4/2010 | McFarlane | 182/106 |

* cited by examiner

*Primary Examiner* — Katherine Mitchell
*Assistant Examiner* — Johnnie A Shablack
(74) *Attorney, Agent, or Firm* — Montgomery Patent & Design, LLC; Robert C. Montgomery; Joseph T. Yaksich

(57) ABSTRACT

A bracket system enabling secure attachment and access of a ladder thereto a flatbed type trailer used with tractor-trailer rigs is herein disclosed, comprising two (2) generally square metal plates. One (1) side of the metal plate is provided with a narrow "U"-shaped cut-out which slides over a rub rail feature typically provided around the perimeter of a flatbed trailer. The exterior portion of each plate is then bolted to the side rails of a ladder. The plates are located so the ladder is completely supported and the bottom of the ladder is positioned approximately one (1) foot off of grade to allow use of the bracket system on any type of terrain.

11 Claims, 8 Drawing Sheets

LADDER STABILIZER FOR FLATBED TRUCK

RELATED APPLICATIONS

The present invention was first described in a notarized Official Record of Invention on Apr. 4, 2008, that is on file at the offices of Montgomery Patent and Design, LLC, the entire disclosures of which are incorporated herein by reference.

FIELD OF THE INVENTION

The present invention relates generally to a bracket device enabling secure attachment and access of a ladder thereto a flatbed type truck or trailer and, more particularly, to said device comprising two (2) metal plates provided with a narrow "U"-shaped cut-out which engaging a rub rail feature typically provided around the perimeter of a flatbed trailer and bolted to the side rails of a ladder, thereby providing upper access thereto a trailer load and providing a firm hand grip surface when exiting or entering the ladder therefrom the flatbed trailer.

BACKGROUND OF THE INVENTION

Loading and off-loading items from a flat bed truck presents unique challenges. During the task of loading or unloading such items, it often becomes necessary to access the bed portion of the trailer. Due to the height of the trailer, often the driver or dock worker must climb on the tires or other support structure not intended for such use, which places the safety of the person in jeopardy. It is often also necessary to reach the upper part of the load for placing tarps, straps, like. Frequently, these tasks must occur on uneven ground present at construction sites and the like where a ladder cannot be adequately stabilized. Accordingly, there exists a need for a means to reach the storage area of a flatbed trailer in a safe manner without the disadvantages as listed above. The development of the invention herein described fulfills this need.

There have been attempts in the past to invent accessories for stabilizing ladders. U.S. Pat. No. 7,293,630 issued to Trebec discloses a ladder stabilization device that appears to comprise leg members that are attached to a ladder via a pole-like structure that runs through a ladder laterally. Unfortunately, this patent does not appear to disclose a pair of bracket plates that are bolted onto the rails of a ladder with each bracket plate specifically designed to fit into existing holes on a flatbed truck.

U.S. Patent Application Number 2007/0182194 issued to Wood et al. discloses a ladder that is hingedly connected to a pick-up truck tailgate. Unfortunately, this patent application does not appear to disclose a pair of bracket plates that can be bolted onto the rails of a ladder and that maintain the ladder at a designated distance above the surface of the ground and permit a user to vertically access the bed of a flatbed truck.

U.S. Pat. No. 6,578,666 issued to Miller discloses a portable safety ladder assembly for a truck trailer that appears to comprise a ladder that is attached to the side of a tractor trailer. Unfortunately, this patent does not appear to disclose a pair of brackets specifically designed to fit in the provided holes of a flatbed truck that may be bolted onto any desired section of ladder.

U.S. Pat. No. 6,257,534 issued to Finley appears to disclose a pair of ladder brackets that will secure a ladder to a work vehicle. Unfortunately, this patent does not appear to disclose a pair of bracket plates that are bolted onto the rails of a ladder with each bracket plate specifically designed to fit into existing holes on a flatbed truck.

U.S. Pat. No. 4,923,103 issued to Sauber discloses a bracket for mounting a ladder to a vehicle in a horizontal manner. Unfortunately, this patent does not appear to disclose a pair of ladder brackets that will mount a ladder to a flatbed truck for use of the ladder to access the load present in the bed.

U.S. Pat. No. 4,751,981 issued to Mitchell et al. discloses a detachably-mounted ladder rack that appears to maintain a ladder in a horizontal fashion over the bed of a pick-up truck. Unfortunately, this patent does not appear to disclose a pair of bracket plates that are bolted onto a ladder section to permit the user to access the bed of a flatbed truck.

U.S. Pat. No. 4,483,416 issued to Garcia discloses a telescoping height-adjustable roof-engaging attachment for ladders that appears to comprise elements that grippingly interact with a surface such as a roof. Unfortunately, this patent does not appear to disclose a pair of bracket plates that are bolted onto the rails of a ladder with each bracket plate specifically designed to fit into existing holes on a flatbed truck.

U.S. Pat. No. 4,482,029 issued to Prochaska discloses a ladder that appears to mount on the side of a truck box and that vertically pivots in relation to the truck box with the ground surface. Unfortunately, this patent does not appear to disclose a ladder stabilizer for flat bed trucks that maintains a ladder in a vertical orientation, nor does it appear to disclose a pair of ladder brackets that interact with the holes on a flatbed truck to maintain a ladder elevated from the ground surface.

U.S. Pat. No. 3,989,122 issued to Jenkins discloses a folding ladder for trucks that appears to be permanently mounted behind the cab of a truck. Unfortunately, this patent does not appear to disclose a removable ladder for flat bed trucks that comprises a pair of bracket plates bolted to a ladder section that fit into the holes on a flatbed truck to stabilize a ladder.

U.S. Pat. No. D 289,007 issued to Garcia disclosing a ladder bracket and U.S. Pat. No. D 290,931 issued to Powell disclosing a ladder hook bracket both appear to comprise brackets that may be attached to ladders. Unfortunately, neither of these design patents appear to be similar in appearance to the disclosed device, nor do they appear to comprise bracket plates that may be bolted onto a ladder so as to fit the holes in a flatbed truck.

None of the prior art particularly describes a bracket device enabling secure attachment and access of a ladder thereto a flatbed type trailer that the instant device possesses. Accordingly, there exists a need for a means to reach the storage area of a flatbed trailer in a safe manner that operates without the disadvantages as described above.

SUMMARY OF THE INVENTION

In light of the disadvantages in the prior art as previously described, it is apparent that there is a need for a ladder stabilizer for a flatbed truck or trailer which provides a bracket system for application to a ladder enabling secure attachment and access of a ladder to a flatbed type truck or trailer.

An object of the ladder stabilizer for flatbed trucks is to position a ladder such that in use, the ladder is held vertically on a flatbed truck approximately one (1) foot off of the grade to allow use of the device on any type of terrain.

Another object of the ladder stabilizer for flatbed trucks is used with a ladder section approximately eight (8) feet in length to provide a user with upper access to a load and to provide a firm hand gripping means when exiting or entering the ladder from a flatbed truck or trailer.

A further object of the ladder stabilizer for flatbed trucks comprises a pair of rectangular aluminum bracket plates having approximate dimensions of six (6) inches by six (6) inches by three-eighths (3/8) of an inch thick.

Still another object of the ladder stabilizer for flatbed trucks comprises two (2) bracket plates each comprising a narrow "U"-shaped cut-out slot which slides over a rub rail portion typically provided around a perimeter region of a flatbed truck or trailer.

Still a further object of the ladder stabilizer for flatbed trucks comprises said bracket plates to be bolted to the side rails of a ladder.

Yet another object of the ladder stabilizer for flatbed trucks comprises particular machined features providing a permanent mounting means thereto a section of ladder and a temporary attachment means to the rub rail portion of a flatbed truck or trailer.

An aspect of the ladder stabilizer for flatbed trucks comprises a pair of aluminum bracket plates, each of which is bolted to opposing ladder side rails at identical heights and orientated so as to extend in a forward direction toward the flatbed truck or trailer.

Another aspect of the ladder stabilizer for flatbed trucks comprises a bracket plate comprising a pair of mounting apertures, a slot, and a notch. The mounting apertures comprise holes drilled through being vertically aligned with one (1) another.

A further aspect of the ladder stabilizer for flatbed trucks comprises a slot that provides a radial and vertical positioning means thereto the device and attached ladder. The slot provides an insertion means thereto a rub rail portion of the flatbed truck or trailer.

Still another aspect of the ladder stabilizer for flatbed trucks comprises a notch that provides additional stability to the device being positioned so as to rest upon an upper trailer surface, thereby supporting anticipated torsion forces applied by a user while climbing thereupon the ladder.

A method of utilizing the device may be achieved by performing the following steps: pre-drilling the two (2) ladder side rails of the section of ladder with holes which correspond to the mounting aperture portions of the bracket plates using provided templates and/or instructions; assembling the two (2) bracket plates to opposing outside surfaces of said ladder side rails using provided fasteners; mounting the ladder and device assembly to a flatbed trailer by inserting the rub rail portion of the flatbed trailer into the slot portion of the bracket plates; climbing the ladder as needed to service the flatbed trailer or load portion in a normal manner; and, benefiting from increased safety and reduced effort while climbing onto or off of a flatbed trailer using the present invention.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

Figure 1:
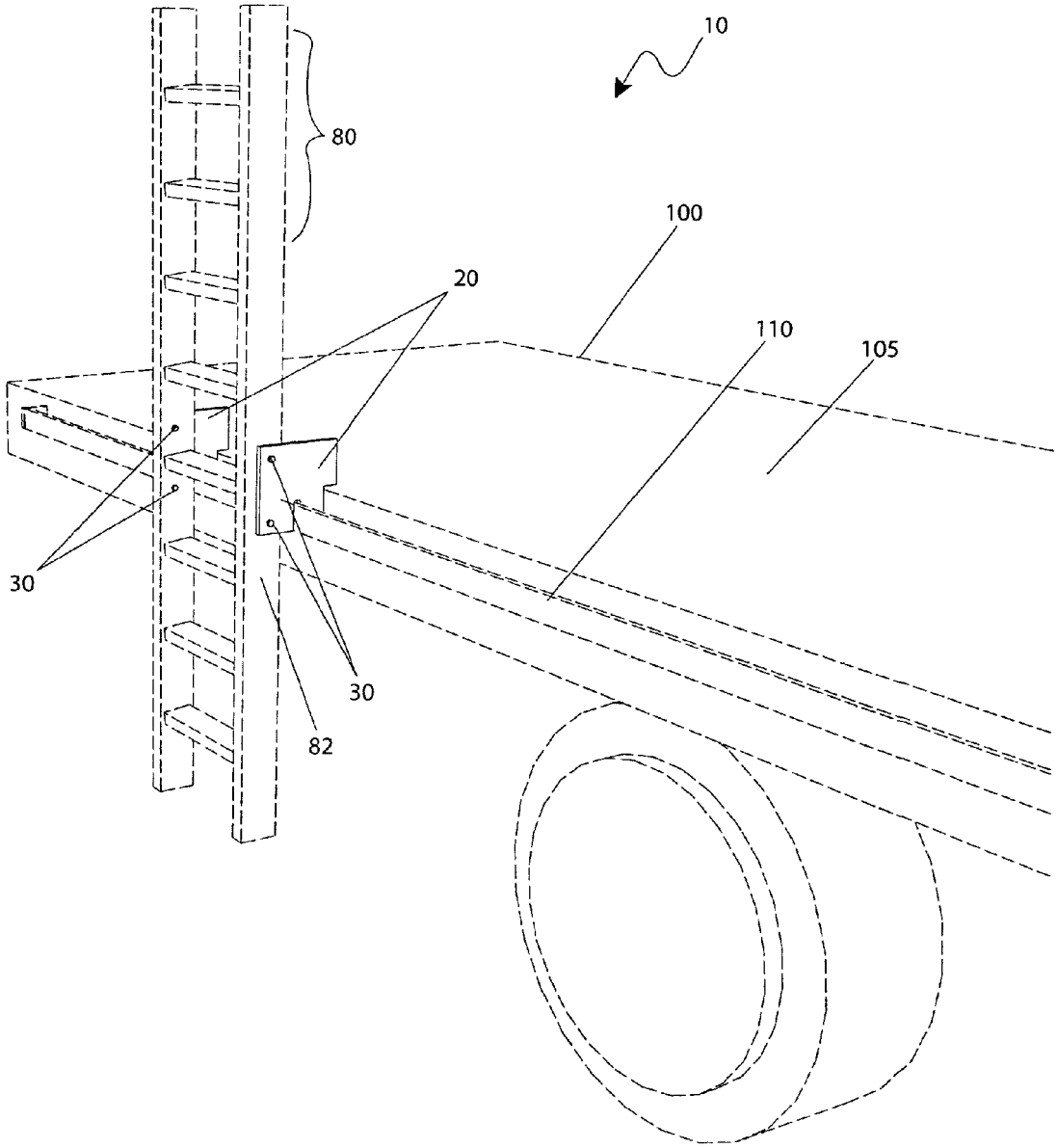
FIG. 1 is an environmental view of a ladder stabilizer for a flatbed truck 10, according to a preferred embodiment of the present invention.

| DESCRIPTIVE KEY | |
|---|---|
| 10 | ladder stabilizer for a flatbed truck |
| 20 | bracket plate |
| 22 | mounting aperture |
| 24 | slot |
| 26 | notch |
| 27 | width |
| 30 | fastener |
| 80 | ladder |
| 82 | ladder side rail |
| 100 | flatbed trailer |
| 105 | trailer surface |
| 110 | trailer rub rail |

DETAILED DESCRIPTION OF THE PREFERRED EMBODIMENT

The best mode for carrying out the invention is presented in terms of its preferred embodiment, herein depicted within FIGS. 1 through 8. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for a ladder stabilizer for a flatbed truck (herein described as the "device") 10, which provides a bracket system for application thereto a ladder 80 enabling secure attachment and access of a ladder 80 thereto a flatbed type truck or trailer 100. The device 10 comprises a pair of rectangular aluminum bracket plates 20 having approximate dimensions of six (6) inches by six (6) inches by three-eighths (3/8) of an inch thick. Each bracket plate 20 comprises a narrow "U"-shaped cut-out slot 24 which slides over a rub rail portion 110 typically provided around a perimeter region of a flatbed trailer 100. Each bracket plate 20 is then bolted 30 to side rails 82 of a ladder 80. The device 10 is positioned along the ladder 80 such that in use, the ladder 80 is held vertically and approximately one (1) foot off of grade to allow use of the device 10 on any type of terrain. The ladder section 80 to be used with the device 10 is envisioned to be approximately eight (8) feet tall, thereby providing upper access thereto a load as well as providing a firm hand gripping means when exiting or entering the ladder 80 therefrom the flatbed trailer 100.

Figure 2:
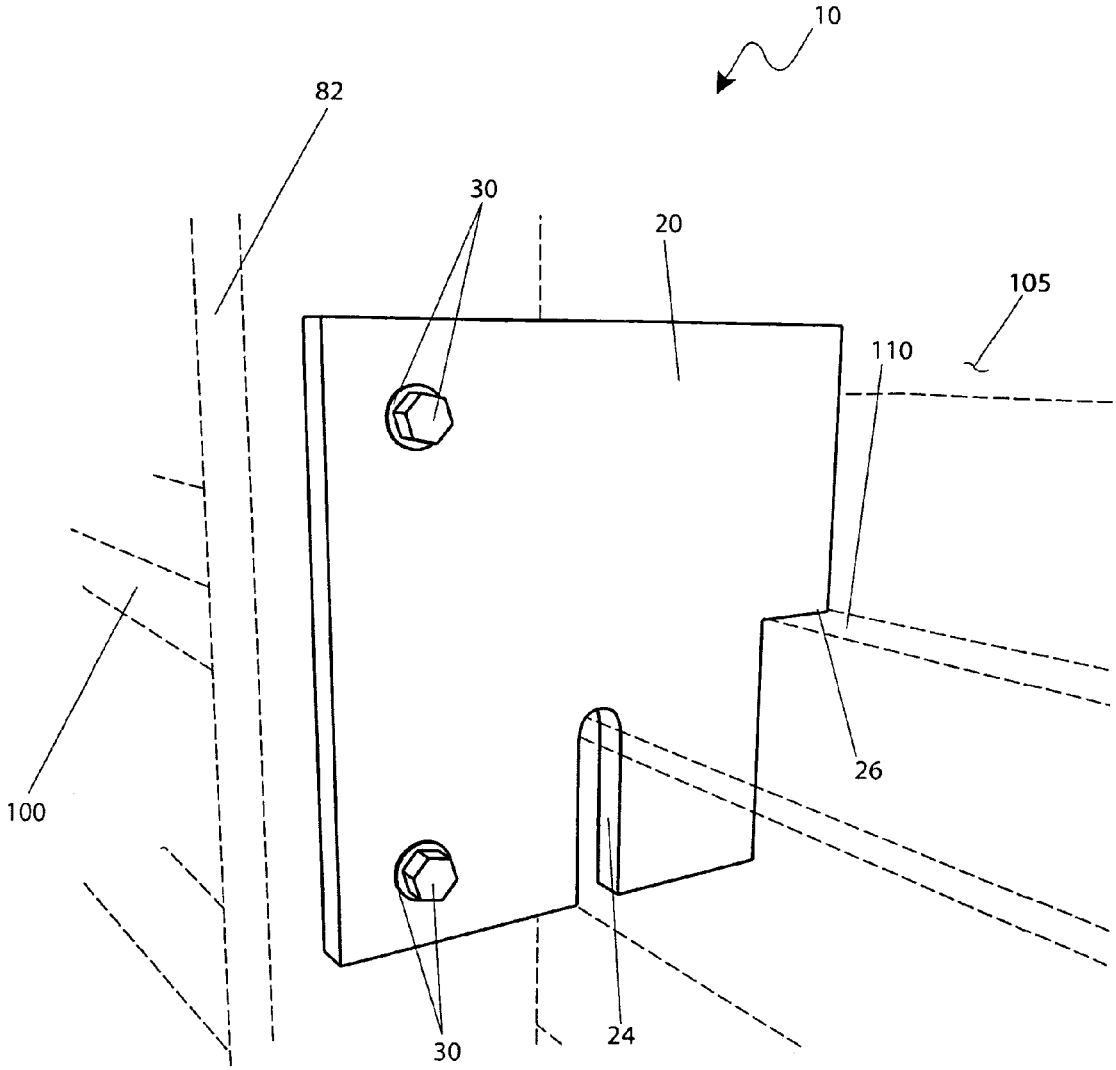
FIG. 2 is a perspective view of a ladder stabilizer for a flatbed truck 10 depicting an in-use state, according to a preferred embodiment of the present invention.
Figure 3:
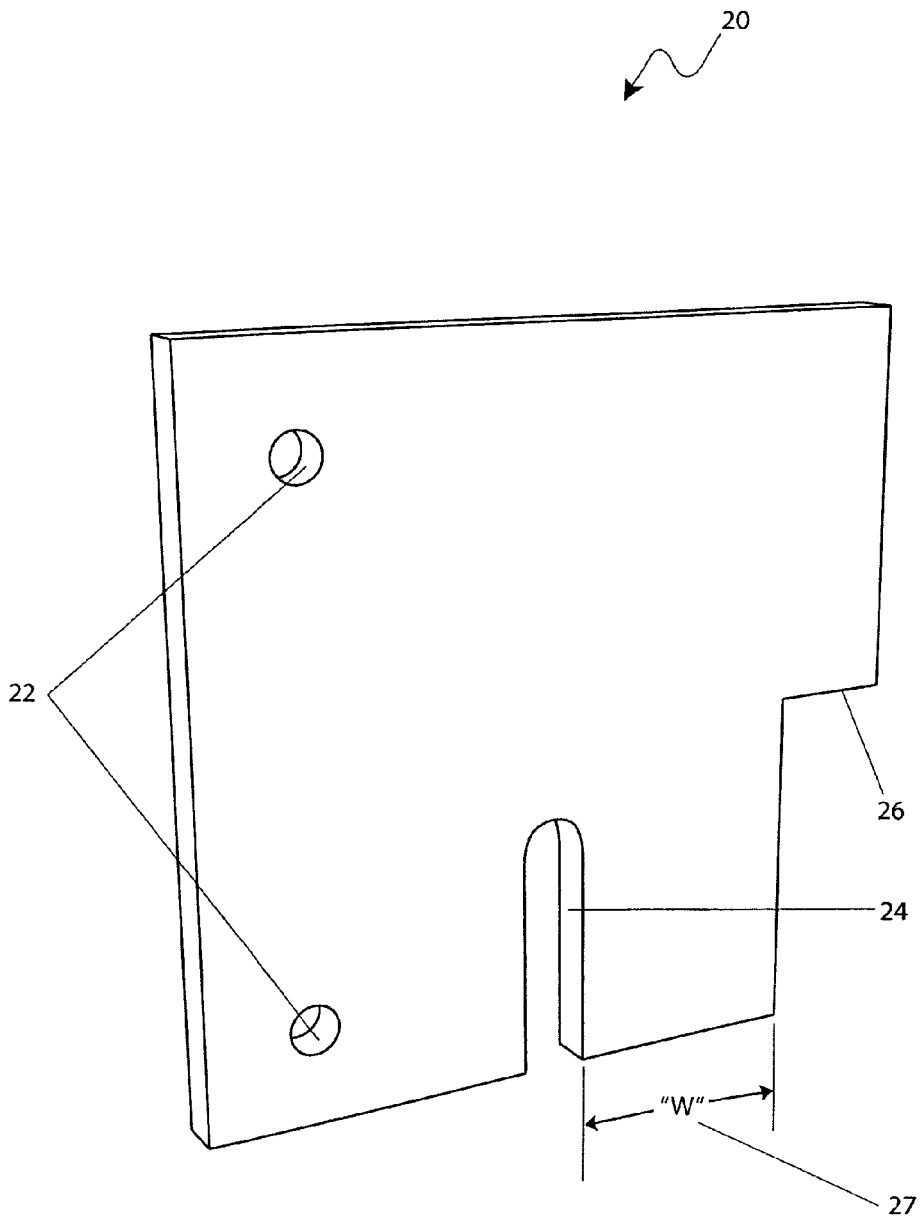
FIG. 3 is a perspective view of a bracket plate portion 20 of the ladder stabilizer for a flatbed truck 10, according to a preferred embodiment of the present invention.
Figure 4:
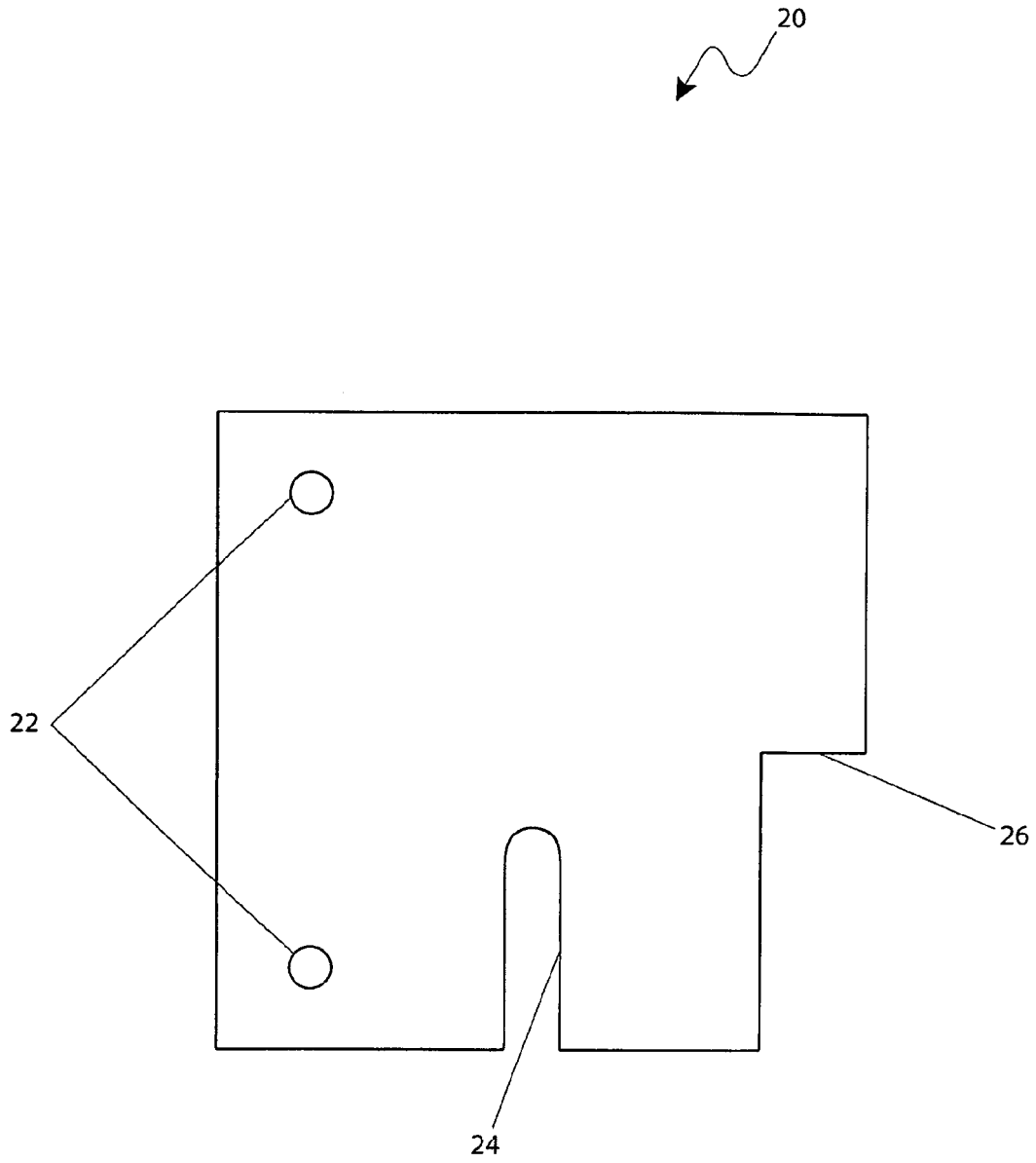
FIG. 4 is a front view of a bracket plate portion 20 of the ladder stabilizer for a flatbed truck 10, according to a preferred embodiment of the present invention.
Figure 5:
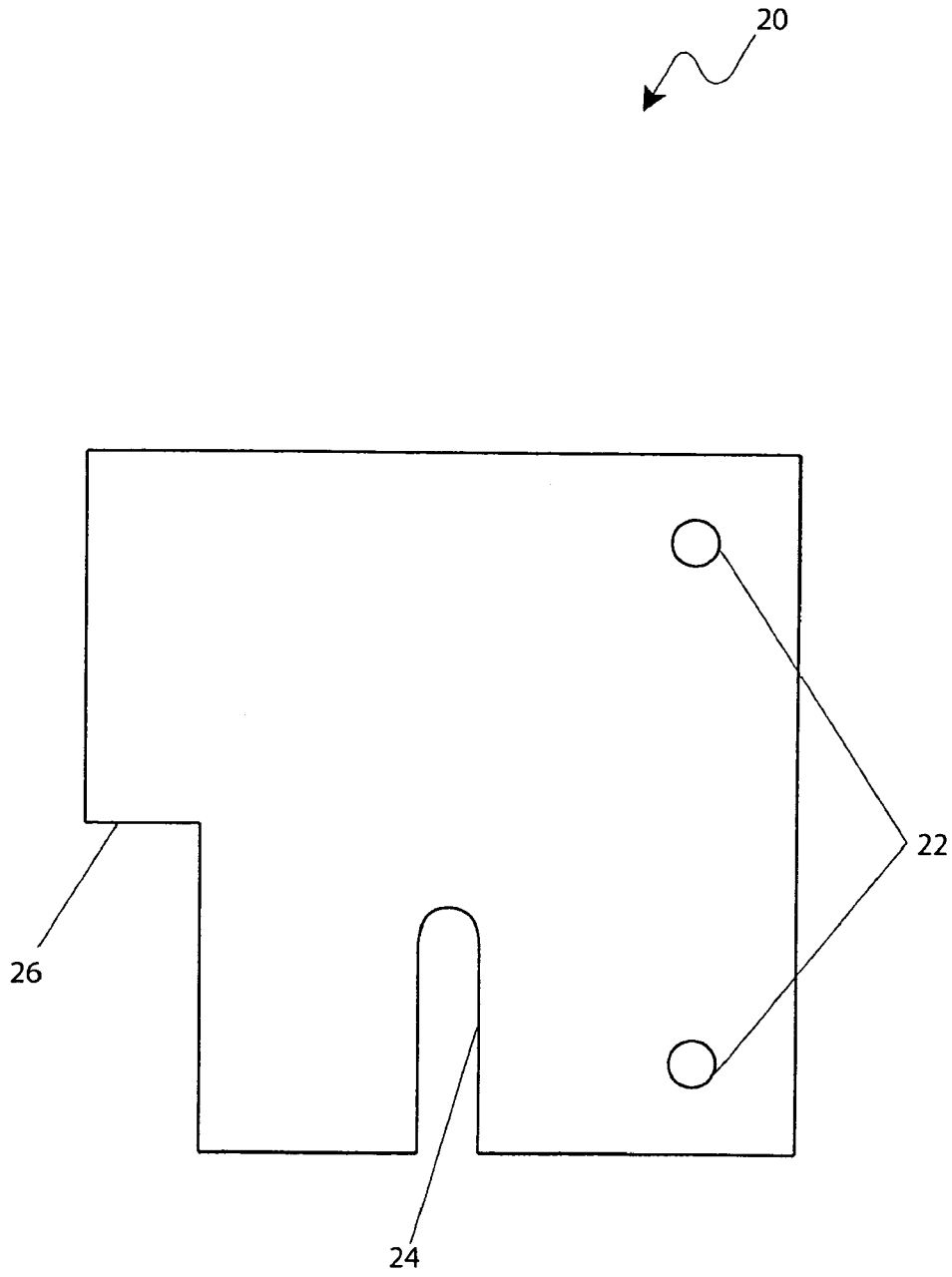
FIG. 5 is a rear view of a bracket plate portion 20 of the ladder stabilizer for a flatbed truck 10, according to a preferred embodiment of the present invention.
Figure 6:
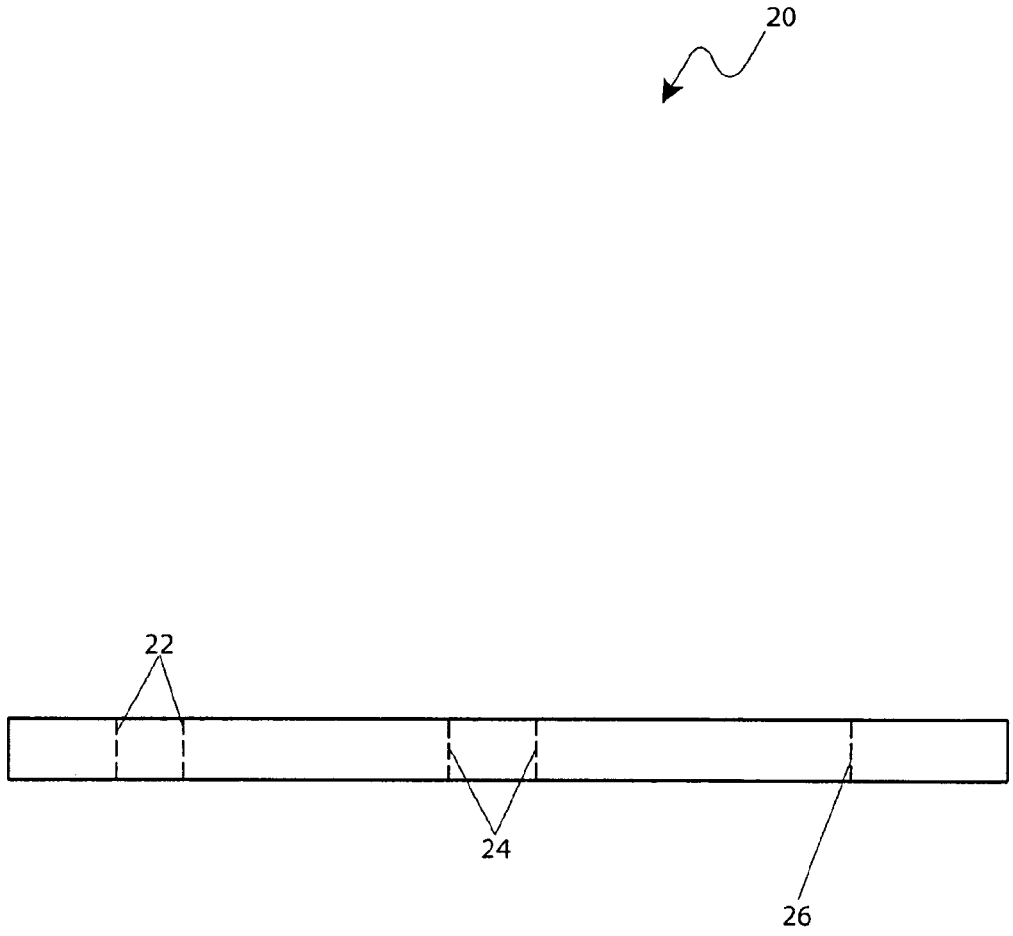
FIG. 6 is a top view of a bracket plate portion 20 of the ladder stabilizer for a flatbed truck 10, according to a preferred embodiment of the present invention.
Figure 7:
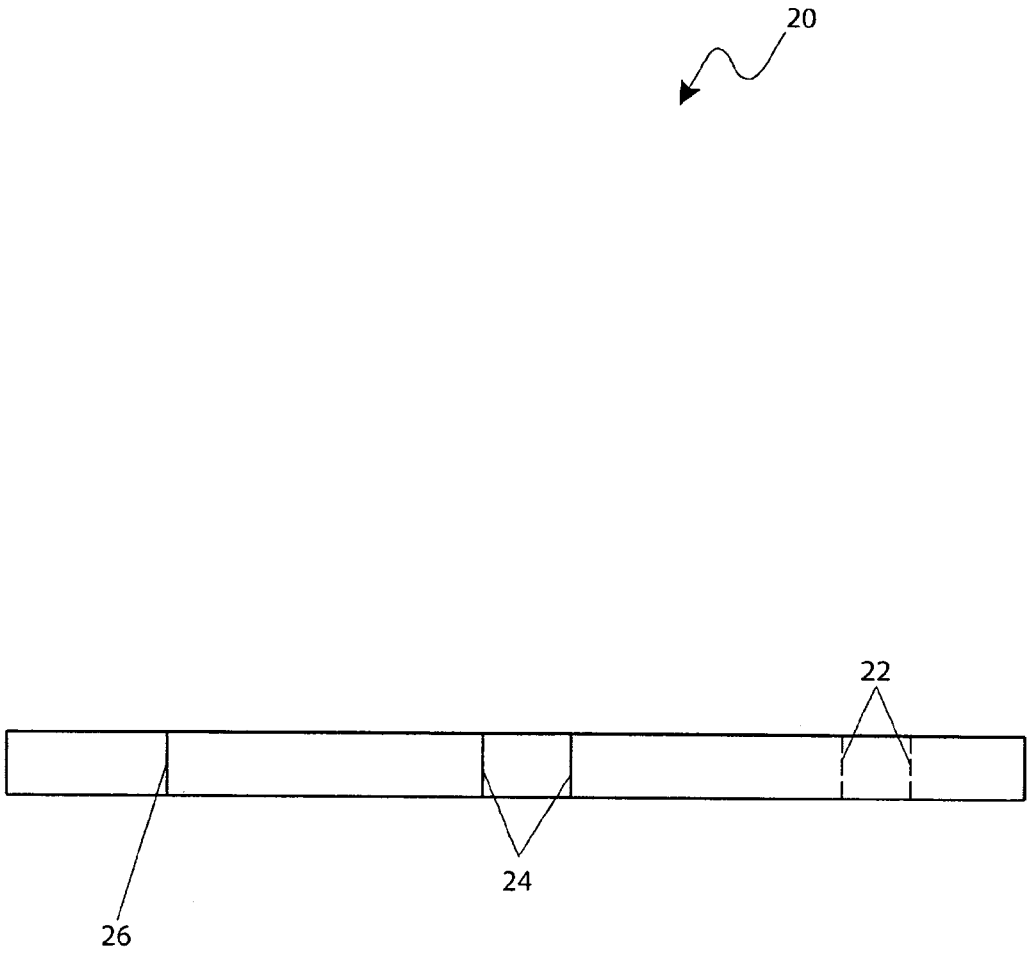
FIG. 7 is a bottom view of a bracket plate portion 20 of the ladder stabilizer for a flatbed truck 10, according to a preferred embodiment of the present invention; and, FIG. 8 is a left side view of a bracket plate portion 20 of the ladder stabilizer for a flatbed truck 10, according to a preferred embodiment of the present invention.
Figure 8:
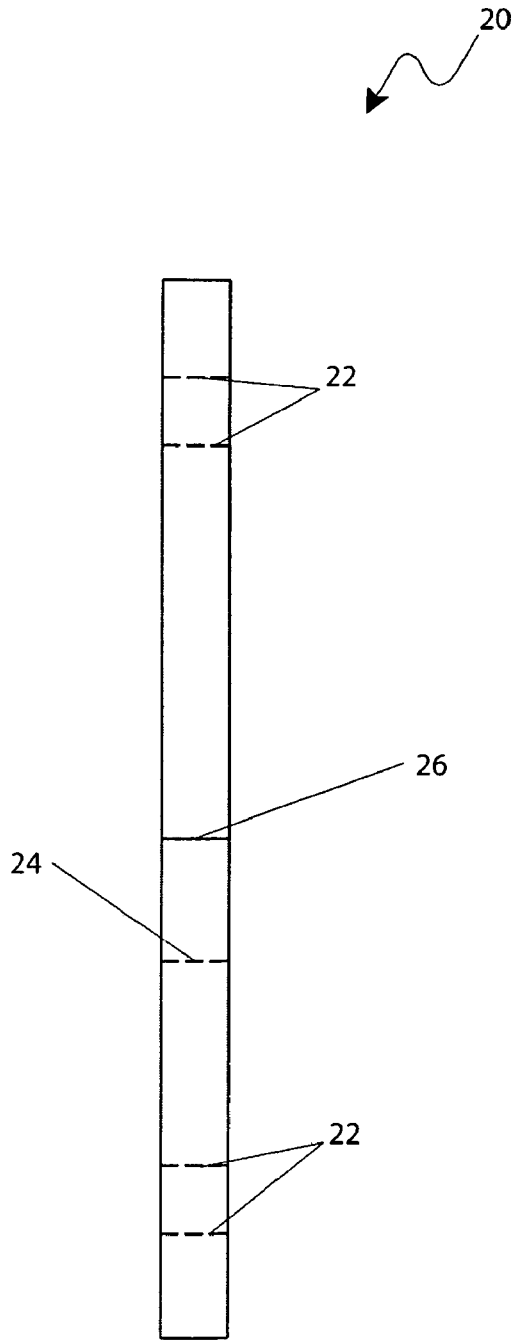

Referring now to FIGS. 1 and 2, environmental and in-use views of the device 10, according to the preferred embodiment of the present invention, are disclosed. The device 10 comprises a pair of high grade aluminum bracket plates 20, each of which is bolted thereto opposing ladder side rails 82 at identical heights and orientated so as to extend in a forward direction toward the flatbed trailer 100. Each bracket plate 20 comprises a pair of mounting apertures 22, a slot 24, and a notch 26. The mounting apertures 22 comprise holes drilled through being vertically aligned therewith one another and approximately four (4) inches therebetween. The slot 24 provides both a radial and vertical positioning means thereto the device 10 and attached ladder 80. The slot 24 provides an insertion means thereto a rub rail portion 110 of the flatbed trailer 100. The bracket plates 20 are installed vertically along the ladder side rails 82 such that the resultant position of the ladder 80 is vertical and approximately one (1) foot above a grade surface during use. The notch 26 provides additional stability thereto the device 10 being positioned so as to rest thereupon an upper trailer surface 105, thereby supporting anticipated torsion forces applied by a user while climbing thereupon the ladder 80. The device 10 further comprises rugged mounting fasteners 30 comprising common hardware such as bolts, flat washers, lock washers, nuts and the like envisioned to be made using stainless steel or equivalent corrosion-resistant materials.

Referring now to FIGS. 3 through 8, various views of the bracket plate portion 20 of the device 10, according to the preferred embodiment of the present invention, are disclosed. The device 10 comprises particular machined features providing a permanent mounting means thereto a section of ladder 80 and temporary attachment thereto the rub rail portion 110 of a flatbed trailer 100. The slot 24 further comprises an open end along a bottom edge portion of the bracket plate 20 and extends upwardly approximately three (3) inches. The slot 24 comprises a particular width dimension being approximately three-eighths (3/8) of an inch which provides a flush insertion thereupon said rub rail portion 110 thereat any point along either side of the flatbed trailer 100. The notch 26 comprises a right angle load bearing feature machined therein the bracket plate 20 which comprises a vertical edge which extends therealong a forward edge providing a resultant width "W" 27 so as to provide a flush fit of the device 10 therewithin a gap typically formed therebetween the rub rail portion 110 and the upper trailer surface 105. The horizontal element of the notch 26 is positioned so as to rest thereupon said trailer surface 105 as previously described.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIGS. 1 and 2.

The method of utilizing the device 10 may be achieved by performing the following steps: pre-drilling the two (2) ladder side rails 82 of the section of ladder 80 with holes which correspond thereto the mounting aperture portions 22 of the bracket plates 20 using provided templates and/or instructions; assembling the two (2) bracket plates 20 thereto opposing outside surfaces of said ladder side rails 82 using provided fasteners 30; mounting the ladder 80 and device 10 assembly thereto the flatbed trailer 100 by inserting the rub rail portion 110 of the flatbed trailer 100 thereinto the slot portion 24 of the bracket plates 20; climbing the ladder 80 as needed to service the flatbed trailer 100 or load portion in a normal manner; and, benefiting from increased safety and reduced effort while climbing onto or off of a flatbed trailer 100 using the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A ladder stabilizer device for a flatbed truck having a flatbed trailer and a trailer rub rail, comprising:

a first bracket plate and a second bracket plate each comprising:

a slot located on a lower area providing an insertion means thereto said rub rail portion; and, a notch located on a first outer edge providing a stability means thereto said device by resting thereupon said trailer surface;

wherein said first bracket plate is removably attachable thereto a first side rail of a ladder and said second bracket plate is removably attached thereto a second side rail of said ladder opposite said first side rail;

wherein said device provides a means to secure said ladder to said flatbed trailer;

wherein each of said first and second bracket plates has a smooth planar left face and a smooth planar right face respectively, said smooth planar left and right faces each covering entire surface areas of left and right sides of said first and second bracket plates respectively;

wherein each of said first and second bracket plates has a linear top edge, a linear anterior edge and a linear bottom edge, wherein said first outer edge is linear and located posterior relative to said linear anterior edge;

wherein each of said slot and said notch pass through said smooth planar left and right faces respectively;

wherein said slot extends from said linear bottom edge and has a U-shaped terminal end;

wherein said notch extends from said linear bottom edge and has a linear terminal end registered orthogonal to said linear posterior edge and said first outer edge; and, wherein said slot is spaced from said notch by a predetermined distance equal to a distance between the trailer surface and rub rail portion.

2. The device of claim 1, wherein each of said first bracket plate and said second bracket plate are approximately six (6) inches by six (6) inches by three-eighths (3/8) inches thick.

3. The device of claim 1, wherein each of said first bracket plate and said second bracket plate are aluminum.

4. The device of claim 1, wherein said slot is approximately three (3) inches long.

5. The device of claim 1, wherein said ladder is approximately one (1) foot above a ground surface when secured thereto said flatbed trailer by said device.

6. The device of claim 1, wherein said first bracket plate and said second bracket plate each further comprise a pair of mounting apertures located near a second outer edge and vertically aligned theretogether, thereby allowing a pair of fasteners therethrough for attaching said first bracket plate thereto said first side rail of said ladder and said second bracket plate thereto said second side rail of said ladder.

7. The device of claim 6, wherein said pair of mounting apertures are approximately four (4) inches apart.

8. A ladder stabilizer device for a flatbed truck having a flatbed trailer and a trailer rub rail, comprising:

a first bracket plate and a second bracket plate each comprising:

a slot located on a lower area providing an insertion means thereto said rub rail portion;

a notch located on a first outer edge providing a stability means thereto said device by resting thereupon said trailer surface; and, a pair of mounting apertures located near a second outer edge and vertically aligned theretogether, thereby allowing a pair of fasteners therethrough for removably attaching said first bracket plate thereto a first side rail of a ladder and said second bracket plate thereto a second side rail of said ladder;

wherein said device provides a means to secure said ladder to said flatbed trailer;

wherein each of said first and second bracket plates has a smooth planar left face and a smooth planar right face respectively, said smooth planar left and right faces each covering entire surface areas of left and right sides of said first and second bracket plates respectively;

wherein each of said first and second bracket plates has a linear top edge, a linear anterior edge and a linear bottom edge, wherein said first outer edge is linear and located posterior relative to said linear anterior edge;

wherein each of said slot and said notch pass through said smooth planar left and right faces respectively;

wherein said slot extends from said linear bottom edge and has a U-shaped terminal end;

wherein said notch extends from said linear bottom edge and has a linear terminal end registered orthogonal to said linear posterior edge and said first outer edge; and, wherein said slot is spaced from said notch by a predetermined distance equal to a distance between the trailer surface and rub rail portion.

9. The device of claim 8, wherein said ladder is approximately one (1) foot above a ground surface when secured thereto said flatbed trailer by said device.

10. A method for using a ladder stabilizer device for a flatbed truck having a flatbed trailer and a trailer rub rail, said method comprising the steps of:

providing said device, comprising:

a first bracket plate and a second bracket plate each comprising:

a slot located on a lower area providing an insertion means thereto said rub rail portion;

a notch located on a first outer edge providing a stability means thereto said device by resting thereupon said trailer surface; and, a pair of mounting apertures located near a second outer edge and vertically aligned theretogether, thereby allowing a pair of fasteners therethrough for removably attaching said first bracket plate thereto a first side rail of a ladder and said second bracket plate thereto a second side rail of said ladder;

wherein said device provides a means to secure said ladder to said flatbed trailer;

pre-drilling said first side rail and said second side rail of said ladder with holes which correspond thereto said pair of mounting apertures;

assembling said first bracket plate and said second bracket plate thereto opposing outside surfaces of said first side rail and said second side rails using said pair of fasteners;

mounting said ladder and said device thereto said flatbed trailer by inserting said trailer rub rail of said flatbed trailer thereinto said slot of each of said first bracket plate and said second bracket plate;

climbing said ladder as needed to service said flatbed trailer in a normal manner; and, benefiting from increased safety and reduced effort while climbing onto or off of said flatbed trailer using said device;

wherein each of said first and second bracket plates has a smooth planar left face and a smooth planar right face respectively, said smooth planar left and right faces each covering entire surface areas of left and right sides of said first and second bracket plates respectively;

wherein each of said first and second bracket plates has a linear top edge, a linear anterior edge and a linear bottom edge, wherein said first outer edge is linear and located posterior relative to said linear anterior edge;

wherein each of said slot and said notch pass through said smooth planar left and right faces respectively;

wherein said slot extends from said linear bottom edge and has a U-shaped terminal end;

wherein said notch extends from said linear bottom edge and has a linear terminal end registered orthogonal to said linear posterior edge and said first outer edge; and, wherein said slot is spaced from said notch by a predetermined distance equal to a distance between the trailer surface and rub rail portion.

11. The method of claim 10, wherein said ladder is approximately one (1) foot above a ground surface when secured thereto said flatbed trailer by said device.

* * * * *